US007441654B2

(12) United States Patent
Liu

(10) Patent No.: US 7,441,654 B2
(45) Date of Patent: Oct. 28, 2008

(54) OPEN REEL SCREWDRIVER TIPS HOLDER

(76) Inventor: Yi-Feng Liu, No. 7, Lane 56, Zhongsheng Rd., Xinzhuang City, Taipei County (TW)

( * ) Notice: Subject to any disclaimer, the term of this patent is extended or adjusted under 35 U.S.C. 154(b) by 281 days.

(21) Appl. No.: 11/516,638

(22) Filed: Sep. 7, 2006

(65) Prior Publication Data

US 2008/0093240 A1 Apr. 24, 2008

(51) Int. Cl.
*A45C 11/26* (2006.01)
*B65D 85/28* (2006.01)

(52) U.S. Cl. ..... 206/349; 206/372; 206/373; 206/378

(58) Field of Classification Search ..... 206/349, 206/372, 373, 378; 242/376, 382
See application file for complete search history.

(56) References Cited

U.S. PATENT DOCUMENTS 7,374,042 B2 * 5/2008 Liu ..... 206/372
2004/0222113 A1 * 11/2004 Cullen et al. ..... 206/349
2006/0283739 A1 * 12/2006 Wang ..... 206/379

* cited by examiner

*Primary Examiner*—Sang Kim
(74) *Attorney, Agent, or Firm*—Muncy, Geissler, Olds, & Lowe PLLC

(57) ABSTRACT

An open reel screwdriver tips holder includes a lower cap and a corresponding upper cap. The lower cap has a shaft to couple with a spiral spring coupled with a rotary barrel on the outer side by fastening to a tail end of it. The rotary barrel has an outer wall fastening to a winding band which has a plurality of sleeves located on a surface to hold screwdriver tips and has a drawing head exposed outside an opening of the holder peripheral wall. The rotary barrel has a plurality of latch portions on an inner wall corresponding to a latch tray which has ratchet teeth on the top surface to engage with latch teeth on the bottom of the upper cap which has a pushbutton on the top to push the latch tray downwards so that the winding band can be retracted into the holder.

5 Claims, 6 Drawing Sheets

PRIORT ART

OPEN REEL SCREWDRIVER TIPS HOLDER

FIELD OF THE INVENTION

The present invention relates to a tool kit for holding screwdriver tips and particularly to a holder which houses a spiral winding band to hold a plurality of sleeves on a surface thereof to hold screwdriver tips with the winding band drawable outside to allow the screwdriver tips to be accessed for loading and unloading and a spiral spring which provides a returning force to retract the winding band into the holder.

BACKGROUND OF THE INVENTION

Referring to FIG. 1, a conventional holder for screwdriver tips generally includes a chest 1 made from hard plastics that has a plurality of round cavities 2 to hold screwdriver tips 3. As the screwdriver tips 3 are made of metal and heavy, they are prone to drop out due to tilting during transportation and could result in hazardous conditions. To remedy this problem, some producers adopt a design by coupling the screwdriver tips 3 with the cavities 2 tightly. While such an approach can prevent the screwdriver tips 3 from slipping out, users have to take a greater effort to remove the screwdriver tips 3. Moreover, the plastic chest usually is made in a rectangular shape. It occupies a greater space and is not easy to carry.

SUMMARY OF THE INVENTION

The primary object of the present invention is to provide an open reel screwdriver tips holder. The holder includes an upper cap and a lower cap that are coupled together. The lower cap has a shaft to hold a spiral spring. The spiral spring is coupled with a rotary barrel on the outer side. The rotary barrel is fastened to a tail end of the spiral spring and also has an outer wall fastening to a winding band. The winding band has a surface holding a plurality of sleeves to hold screwdriver tips. The winding band has a drawing head exposed outside an opening formed on the peripheral wall of the holder. The rotary barrel has a plurality of latch portions on an inner peripheral wall. A latch tray is provided to couple with the rotary barrel through the latch portions. The latch tray has ratchet teeth on the top surface. The upper cap has a pushbutton on the top. The pushbutton has insertion struts on the bottom to press the latch tray. By means of such a structure the winding band can be drawn outwards to allow the screwdriver tips to be accessed. By depressing the pushbutton the latch tray escapes latch teeth on the bottom of the upper cap to retract the winding band into the holder. Hence the screwdriver tips can be loaded and unloaded rapidly. It also is easier to carry and saves holding space.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
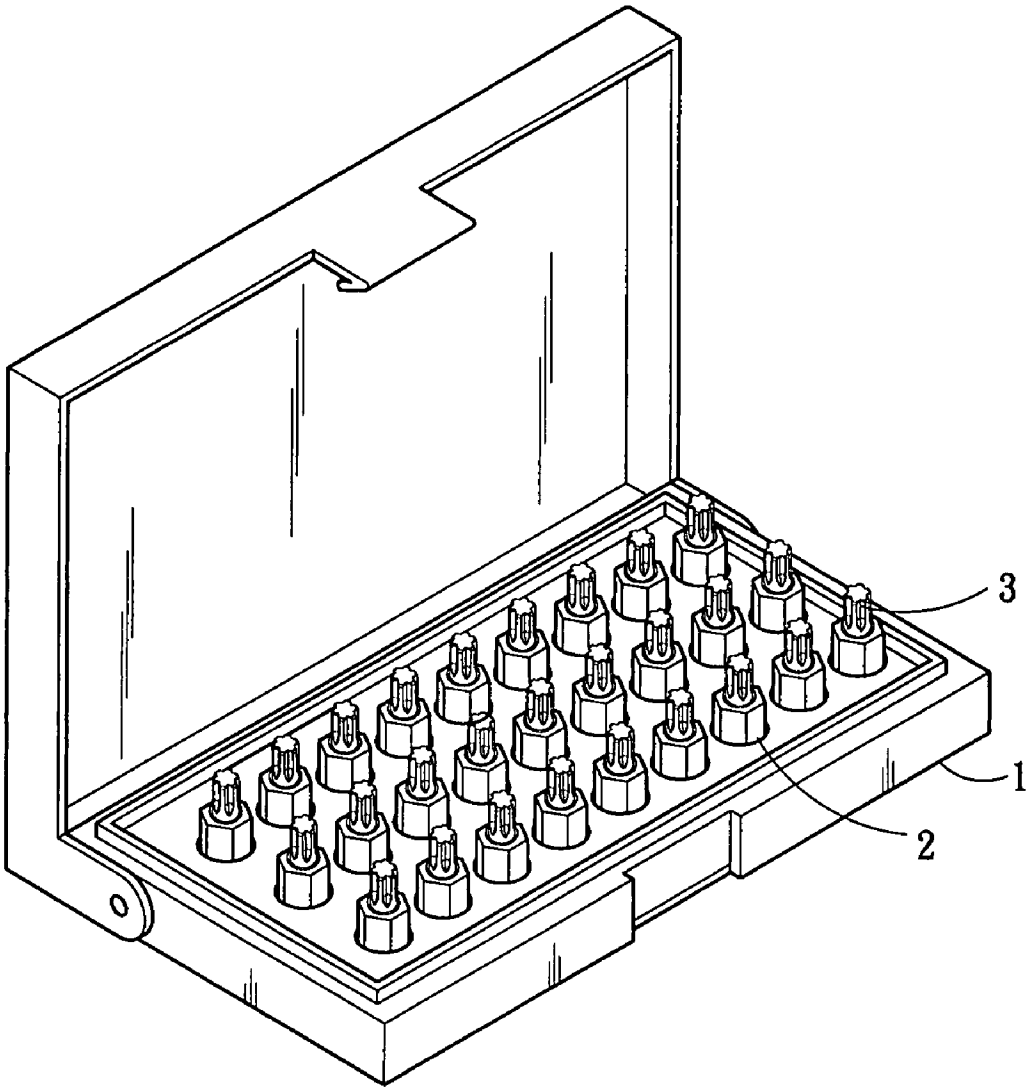
FIG. 1 is a perspective view of a conventional tool kit for holding screwdriver tips.
Figure 2:
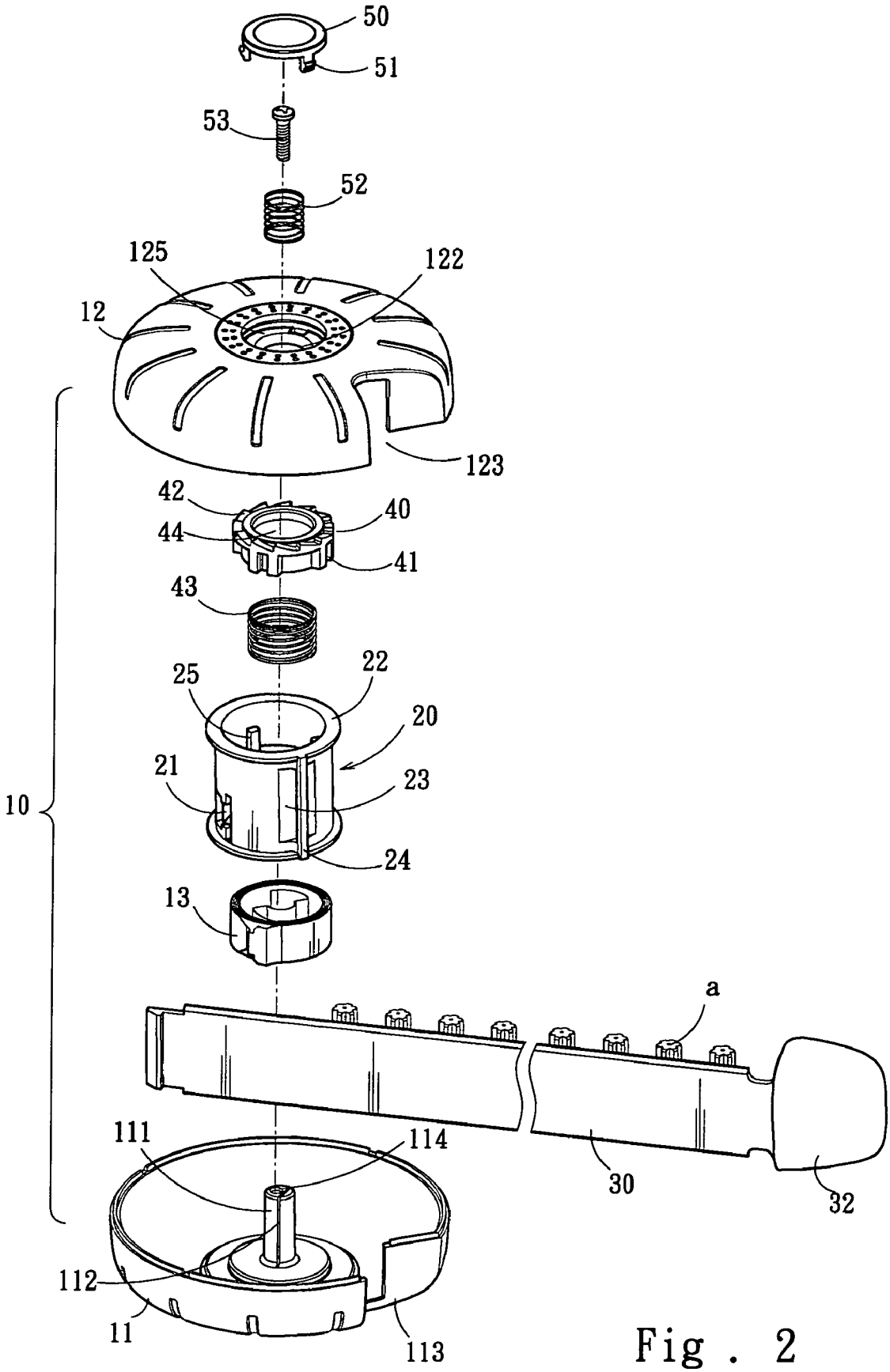
FIG. 2 is an exploded view of a preferred embodiment of the invention.

Please referring to FIGS. 2 through 5A, the open reel screwdriver tips holder 10 according to the invention includes a lower cap 11 and an upper cap 12 that are circular and coupled together. They have respectively a lower notch 113 and an upper notch 123 that are jointly formed an opening. The upper cap 12 has a round center hole 121 in the center. The center hole 121 is surrounded by a recess 122 indented from the top surface. The recess 122 is surrounded by an indented ring 125 which has a greater diameter than the recess 122. The upper cap 12 further has a plurality of latch teeth 124 on a bottom wall of the top thereof.

The lower cap 11 has a circular shaft 111 in the center that has an axial clipping slot 112 to couple with a spiral spring 13 on the periphery through a head end of the spiral spring 13. The spiral spring 13 has a tail end with two adjacent sides inclining inwards to form a T-shape on the tail end. The shaft 111 has a screw hole 114 on the top.

The holder 10 has a hollow rotary barrel 20 which has a spacer 27 in the middle of the interior. The spacer 27 has an aperture 28 in the center to be coupled with shaft 111. The rotary barrel 20 has a lower space to house the spiral spring 13, and a T-shaped latch notch 21 on an outer wall to latch and fasten the tail end of the spiral spring 13. The rotary barrel 20 further has respectively a circular flange 22 on an upper side and a lower side, and an axial indented wall 23 on the outer wall. There is an axial latch strut 24 on an outer side of the indented wall 23. The latch strut 24 has an upper end and a lower end connecting to the flanges 22 so that the latch strut 24 and the indented wall 23 are spaced from each other to form a threading space between them. The rotary barrel 20 further has a plurality of strut type latch portions 25 on an inner wall of an upper side extending from the top surface of the rotary barrel 20 at a selected distance.

Figure 3:
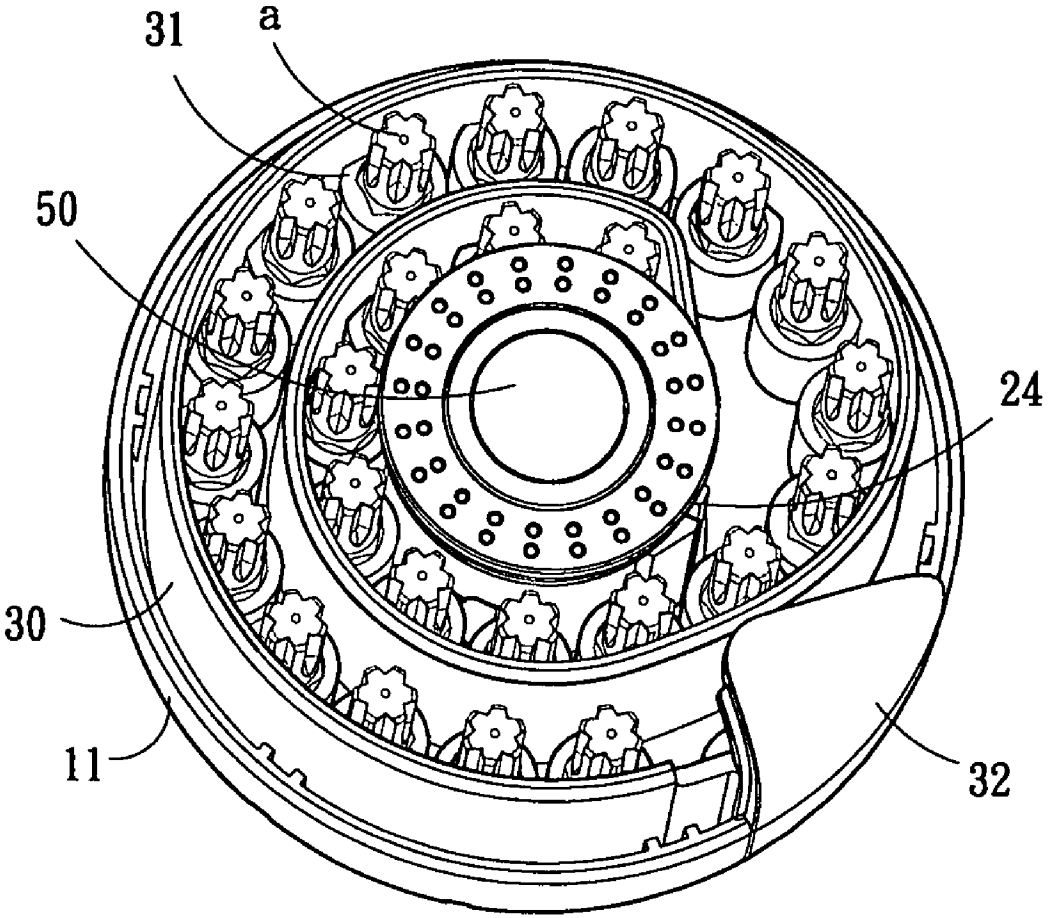
FIG. 3 is a schematic view of a preferred embodiment of the invention showing the interior in the radial direction.
Figure 4:
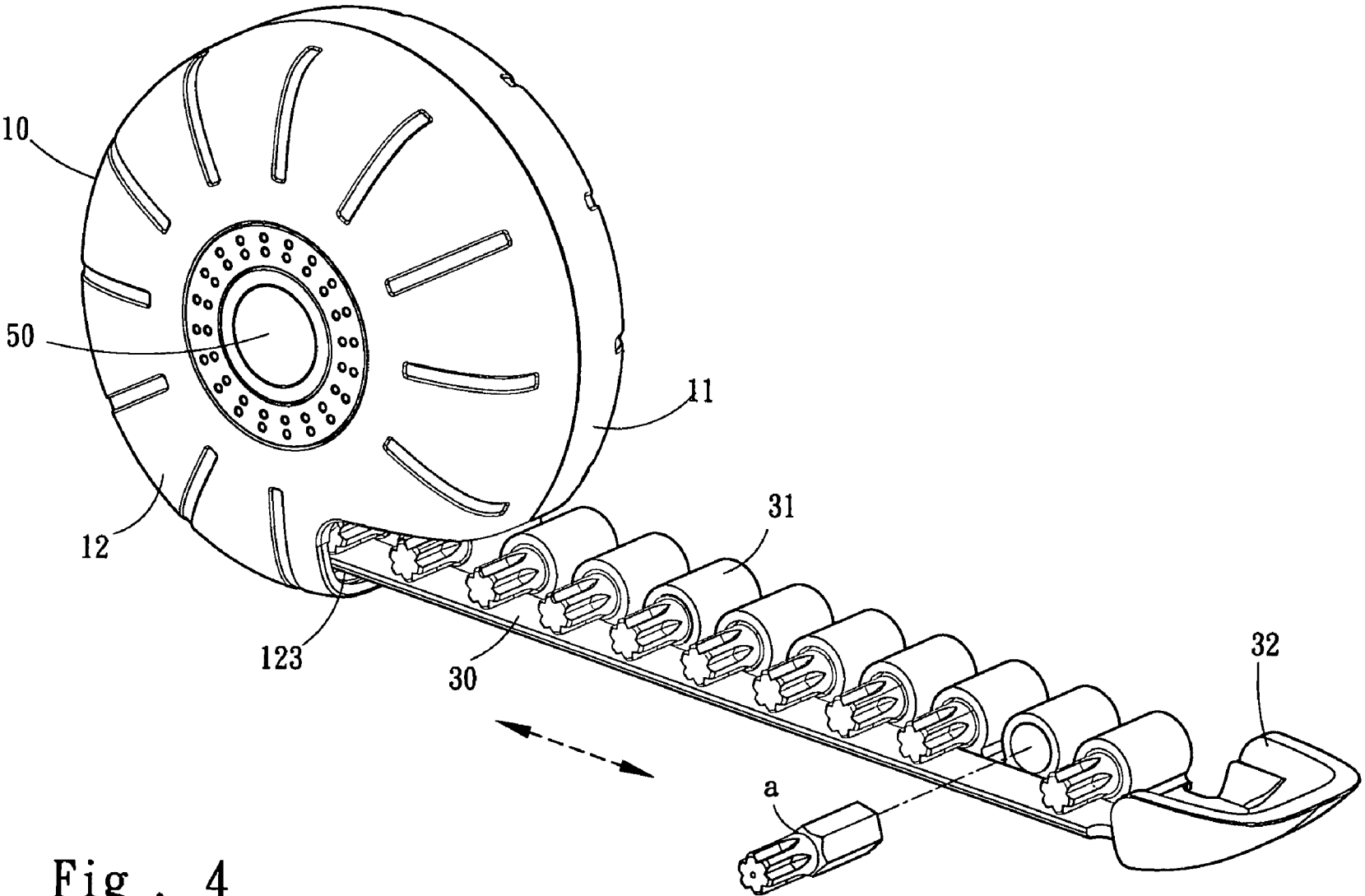
FIG. 4 is a perspective view of a preferred embodiment of the invention.

There is a spiral winding band 30 made from plastics in the holder 10. Referring to FIGS. 3 and 4, the winding band 30 has a head end formed with a hook directing outwards. The head end of the winding band 30 can pass through the threading space of the rotary barrel 20 to be latched on the latch strut 24. The winding band 30 has an inner surface which holds a plurality of sleeves 31 each can hold a screwdriver tip a. The winding band 30 has a tail end to form a drawing end 32 at a greater width than the winding band 30.

There is also a latch tray 40 located in an upper internal space of the rotary barrel 20. The latch tray 40 has a plurality of latch troughs 41 on the peripheral wall. The latch tray 40 can be depressed downwards to allow the latch troughs 41 to be coupled with the latch portions 25 of the rotary barrel 20 such that the latch tray 40 can be rotated with the rotary barrel 20. The latch tray 40 further has a plurality of ratchet teeth 42 on the top surface and a holding cavity 44 in the center of the latch tray 40.

There is a first elastic element 43 (such as a spring) which is extensible axially and held in the inner of the holding cavity 44 of the latch tray 40. The first elastic element 43 has a lower end pressing the spacer 27 of the rotary barrel 20 and an upper end pressing a top wall of the holding cavity 44 of the latch tray 40.

A pushbutton 50 is provided and located on the indented ring 125 of the upper cap 12. It has a plurality of longitudinal insertion struts 51 on the bottom that have a hook on a lower side directing outwards. The insertion struts 51 pass through the upper cap 12 and have the bottom thereof latched on the bottom wall of the top of the upper cap 12.

A second elastic element 52 (such as a spring) which is extensible axially is provided on the bottom of the pushbutton 50 to push the pushbutton 50 upwards.

There is a fastening element 53 (such as a bolt) running through the center hole 121 of the upper cap 12 to engage with the screw hole 114 of the lower cap 11 to couple the upper cap 12 and the lower cap 11 together.

Figure 5A:
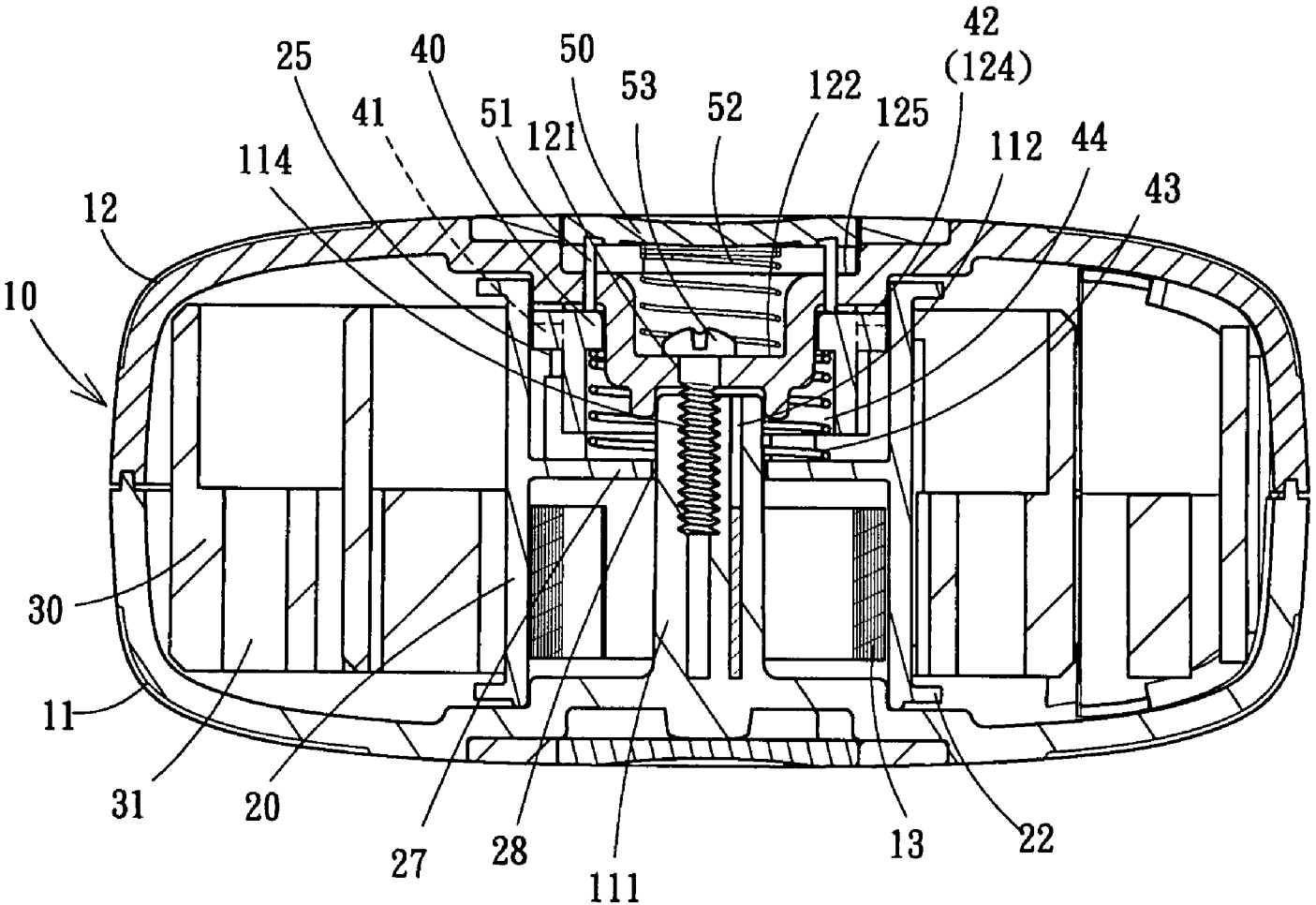
FIG. 5A is a longitudinal sectional view of a preferred embodiment of the invention.
Figure 5B:
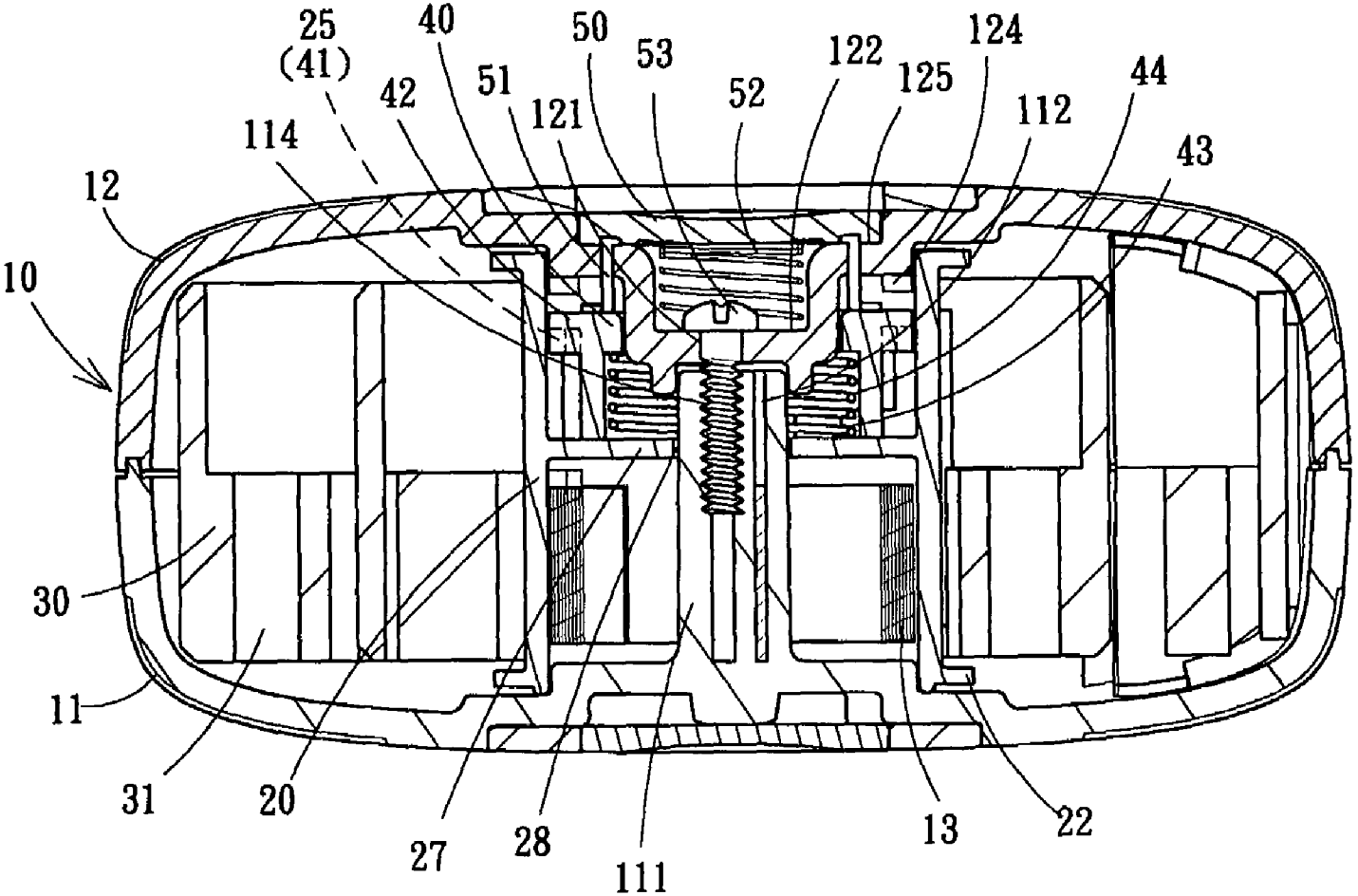
FIG. 5B is a sectional view according to FIG. 5A in an operating condition.

By means of the aforesaid construction, the drawing head 32 of the winding band 30 exposed outside the holder 10 may be pulled outwards by a user's hand as shown in FIG. 4 to draw the winding band 30 out so that the screwdriver tips a in each sleeve 31 can be loaded and unloaded. While the winding band 30 is pulled out, the rotary barrel 20 also drives the spiral spring 13 tighter, and the latch tray 40 on the upper side of the rotary barrel 20 also is rotated synchronously, and the ratchet teeth 42 on the top of the latch tray 40 are latched by the latch teeth 124 on the bottom of the upper cap 12. Hence the winding band 30 is anchored without retracting inwards inversely. Thereby the user can see and select a desired screwdriver tip a, and remove it from the sleeve 31. After the desired screwdriver tip a is removed and retracting the winding band 30 into the holder 10 is desired, depress the pushbutton 50 as shown in FIG. 5B, the insertion struts 51 on the lower side of the pushbutton 50 are moved downwards to press the latch tray 40 downwards to escape the latch teeth 124 of the upper cap 12. The returning force of the spiral spring 13 turns the rotary barrel 20 in the inverse direction and retracts the winding band 30 inwards at the same time. Therefore the screwdriver tips a held in the sleeves 31 of the winding band 30 can be housed in the holder 10 again. The entire structure is smaller. Storing and removing of the screwdriver tips a are easier, and carrying is more convenient. Once user's hand is released, the first elastic element 43 in the rotary barrel 20 pushes the latch tray 40 upwards so that the ratchet teeth 42 on the top surface of the latch tray 40 engage with the latch teeth 124 of the upper cap 12, and the second elastic element 52 on the bottom of the pushbutton 50 pushes the pushbutton 50 upwards to its original position.

Prototypes of the invention have been made and tested with desired results. This invention is novel and provides a significant improvement over the conventional tool kits now on the market.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An open reel screwdriver tips holder, comprising:

a lower cap and an upper cap coupling together, the lower cap having a lower notch on a lower peripheral wall and a circular shaft in the center to couple with a spiral spring by fastening a head end of the spiral spring to the shaft, the shaft having a screw hole on the top thereof; the upper cap having an upper notch on an upper peripheral wall corresponding to the lower notch to form an opening, a center hole in the center, a recess on the top surface around the center hole, an indented ring above the recess at a greater diameter, and at least one latch tooth on a bottom wall of the top of the upper cap;

a rotary barrel having an aperture in the center to couple on the shaft, an outer wall fastening to a tail end of the spiral spring, and at least one strut type latch portion on an inner wall thereof;

a spiral winding band surrounding the rotary barrel and having a head end fastening to the rotary barrel and a tail end exposed outside the opening of the holder, and a plurality of sleeves on a surface thereof to hold screwdriver tips;

a latch tray which is located above the rotary barrel and has at least one latch trough on the periphery to be coupled with the latch portion of the rotary barrel, a plurality of ratchet teeth on the top and a holding cavity in the center;

a first elastic element which is located in the holding cavity and has a lower end pressing the rotary barrel and an upper end pressing a top wall of the holding cavity;

a pushbutton which is located on the indented ring of the upper cap and has a plurality of longitudinal insertion struts on the bottom to run through the upper cap that respectively form a hook on a lower side directing outwards to latch the bottom wall of the top of the upper cap;

a second elastic element which is located on the bottom of the pushbutton and extendable axially; and a fastening element running through the upper cap to fasten the screw hole of the lower cap.

2. The open reel screwdriver tips holder of claim 1, wherein the shaft of the lower cap has an axial clipping slot, the rotary barrel having a T-shaped latch notch on the outer wall, the spiral spring having the head end clipped in the clipping slot, the tail end of the spiral spring having two sides inclining inwards to form a T-shape to be latched in the latch notch of the rotary barrel.

3. The open reel screwdriver tips holder of claim 1, wherein the rotary barrel has respectively a flange on an upper side and a lower side, a latch strut connecting the two flanges, an indented wall on the outer wall spaced from the latch strut to form a threading space, the head end of the winding band forming a hook directing outwards to latch on the latch strut.

4. The open reel screwdriver tips holder of claim 1, wherein the sleeves are located longitudinally on an inner wall surface of the winding band.

5. The open reel screwdriver tips holder of claim 1, wherein the rotary barrel has a spacer in the middle of the interior, the aperture being formed in the center of the spacer, the rotary barrel having a lower space to hold the spiral spring and an upper space to hold the latch tray.

* * * * *